US008462066B2

(12) United States Patent
Malasani

(10) Patent No.: US 8,462,066 B2
(45) Date of Patent: Jun. 11, 2013

(54) LONG-DISTANCE WIRELESS-LAN DIRECTIONAL ANTENNA ALIGNMENT

(76) Inventor: Rammohan Malasani, Taipei (TW)

( * ) Notice: Subject to any disclaimer, the term of this patent is extended or adjusted under 35 U.S.C. 154(b) by 754 days.

(21) Appl. No.: 12/727,820

(22) Filed: Mar. 19, 2010

(65) Prior Publication Data

US 2010/0238083 A1 Sep. 23, 2010

Related U.S. Application Data

(60) Provisional application No. 61/162,132, filed on Mar. 20, 2009.

(51) Int. Cl.
*H01Q 3/00* (2006.01)

(52) U.S. Cl.
USPC ..... 343/766; 343/765

(58) Field of Classification Search
USPC ..... 343/757, 763, 765, 766, 880, 882, 343/890, 892
See application file for complete search history.

(56) References Cited

U.S. PATENT DOCUMENTS 8,200,150 B2 * 6/2012 Lopez et al. ..... 455/13.2
2002/0057225 A1 * 5/2002 Spirtus ..... 343/766

OTHER PUBLICATIONS

Aironet 350 Series Bridge Hardware Installation Guide, p. C-5 to C-6.
Ubiquiti Networks NanoStation2 Datasheet, p. 2.

* cited by examiner

*Primary Examiner* — Robert Karacsony
*Assistant Examiner* — Hasan Islam
(74) *Attorney, Agent, or Firm* — Stephen E. Zweig

(57) ABSTRACT

A unitized device and method to optimize directional antenna alignment for long-distance communications using the low-cost IEEE 802.11 (and related) compatible RF-chipsets (originally designed for short range Wireless-LAN and Wireless-PAN networks). The device combines these chipsets, along with a microprocessor, software, electronics to drive a directional antenna, and the motors and gearing necessary to physically move a directional antenna, into a unitized low weight, and low cost assembly designed to enable reliable digital radio links of many miles or more to be established with minimal costs, time, and installer skill. In one embodiment, the software methods incorporated into the software of this unitized device can include methods necessary to automatically or semi-automatically configure and align the directional antenna to one or more distant target sources. Various mechanical designs, as well as various software and electronics methods, are also disclosed.

30 Claims, 9 Drawing Sheets

LONG-DISTANCE WIRELESS-LAN DIRECTIONAL ANTENNA ALIGNMENT

CROSS REFERENCE TO RELATED APPLICATIONS

This application claims the priority benefit of provisional application No. 61/162,132 "Automated Antenna Alignment for Long Range Wireless Devices", filed Mar. 20, 2009.

BACKGROUND OF THE INVENTION

1. Field of the Invention

The invention is in the general field of Wireless LAN and directional antenna alignment devices and methods.

2. Description of the Related Art

In recent years, a variety of high-speed short range digital radio transceiver devices, in particular wireless local area network (Wireless-LAN or WLAN) devices, and Wireless Personal Area Network (WPAN) devices have become ubiquitous in the modern world. These devices originally assigned to the unlicensed frequency bands such as 2.4 GHz, 900 MHz and later in the 5 Gigahertz region and originally intended for ranges of up to only a few hundred feet, are now so prevalent that the costs for these system chipsets are now down to only a few dollars each.

These Wireless-LAN standards were originally based on the IEEE 802.11 standard, other related short range LAN and PAN standards, such as the IEEE 802.15 (Bluetooth™) and 802.15.4 (Zigbee™) standards have also become popular. Due to the extremely large market for these devices, chipsets capable of implementing these standards as well are also available for only a few dollars each. Like 802.11, these later standards also were originally intended for distances of at most a few hundred feet.

Although a number of long range digital radio transceiver devices (Wireless-Wide Area Networks or WAN)) originally designed for link distances of many miles or more have been developed, the number of devices that implement such long distance standards are orders of magnitude less than the nearly ubiquitous IEEE 802.11 Wi-Fi chips and related 802.15 (Bluetooth) and 802.15.4 (Zigbee standards).

Although some parts of the IEEE 802.11 standards incorporate certain timing constraints related to assumptions involving the time that light (radio signals) take to travel over short range distances, as well as certain assumptions about power levels, and frequencies, the 802.11 standard is otherwise relatively general-purpose and robust. As a result, workers have found that with some software adjustments (for example adjustments that increase window times to account for speed-of-light lag over longer distances), as well as larger and more directional antenna, the ultra-low cost chipsets and electronics originally developed to send digital data signals only a few hundred feet can be modified to send signals over many miles. This makes it possible to use modified Wireless-LAN technology to bring the benefits of long-distance broadband Internet and other modern digital communications technology to rural areas at a cost that is only a small fraction of that of alternate approaches.

As a result, extremely inexpensive Wireless-LAN based access points, relay stations, and user stations are starting to become very popular, and can deliver coverage to lower income and rural areas that otherwise could not afford any alternate form of digital communications or Internet connectivity.

One problem with setting up such modified or "hacked" IEEE 802.11 Wireless-LAN based long distance communications, however is that in order to allow what is essentially short-range equipment and standards to operate over far longer ranges than originally intended, the antennas (on both ends of the communications link) must be fairly large and highly directional. The directional antennas help focus the relatively weak Wireless-LAN radio beam (which often may have RF radio power of at most 1 Watt) and ensure that the low energy radio signals are transmitted to the target, which may be miles away, with enough signal intensity. On the other end, the target in turn often uses large directional antennas to pick up the relatively weak Wireless-LAN signal.

Because both antennas are both highly directional, and must be precisely oriented over distances many miles or more, the difficulties of aligning the directional transmitting and receiving antenna should be appreciated, particularly within the severe budgetary constraints that mandate use of modified or "hacked" IEEE 802.11 equipment for long distance communications in the first place.

At present, prior art methods often involve a tedious process in which an installer climbs onto the structure holding the antenna, talks via a mobile phone or a second set of two-way radios with a counterpart at the other end of the link, and the two manually adjust the antennas and assess the signal strength and signal quality of the link.

For example, Cisco systems, a leading manufacturer of outdoor radios, in Appendix "C", "Antenna Basics" of their "*Cisco Aironet* 350 *Series Bridge Hardware Installation Guide*, page C-5 to C-6" recommends their installation professionals carry GPS tools & compasses to help with alignment on their Aironet 350 series outdoor WiFi radios.

Another popular alignment aid supplied by equipment manufacturers is alignment equipment that has LED indicators that are visible to an installer. In this scheme, a stronger signal illuminates more LED lights. For example, Ubiquiti Networks, a manufacturer of outdoor Wi-Fi radios, has provided such LED lights to help with alignment on their Nanostation2 (*Ubiquiti Networks NanoStation*2 *Datasheet*, page 2).

A third alignment aid found in other prior art alignment equipment includes a sound synthesizer that generates a sound signal whose amplitude is proportional to the signal strength. For example, Trango Systems uses such audio aid in their TrangoLINK-45™ outdoor Wi-Fi radio (*TrangoLINK*-45 *data sheet*)

Additionally, regulatory requirements also require that these installers be qualified professionals, which adds additional cost to this process. The end result is both dangerous to the workers, and not fully satisfactory under all conditions, because unless the structure that the directional antenna is bolted to is quite sturdy, with time the antenna alignment can drift to an unsatisfactory position. Such drift in alignment would not only require a professional installer's service for alignment, but also cause down time to the network till the availability of such an installer.

Although prior art methods for automatically steering satellite antennas and other non-Wireless-LAN directional antennas, exemplified by U.S. Pat. Nos. 4,841,309, 5,214,364, 6,049,306, 6,850,202, 6,864,847, and 7,633,893 are known, these methods tend to be both elaborate and expensive, and are not well suited for the ultra-low cost demands of long distance telecommunications using modified or "hacked" versions of the IEEE 802.11 (Wi-Fi) standard, and its related standards such as 802.15 (Bluetooth) and 802.15.4 (Zigbee) standards. Thus further advances are desirable.

BRIEF SUMMARY OF THE INVENTION

The invention is "combination" or "unitized" device that combines the electronics for a normal or modified IEEE 802.11 (Wi-Fi), IEEE 802.15 or (Bluetooth) or 802.15.4) ultra low cost Wireless LAN or Wireless PAN chipset, along with a microprocessor, software, electronics to drive a directional antenna, and the motors and gearing necessary to physically move a directional antenna, into an ultra-low weight, and ultra-low cost assembly designed enable long-distance communications links to be established with both minimal cost and minimal time and skill on the part of the installers. In one embodiment, the software methods incorporated into the software of this unitized device can include methods necessary to automatically or semi-automatically configure and align the antenna with minimal user skill and effort.

Methods to enable such systems to track multiple target antennas, and to determine optimum settings that represent a compromise between orienting towards multiple targets with differing priority levels, are also discussed.

DETAILED DESCRIPTION OF THE INVENTION

As previously discussed, this invention is designed for operation with ultra-low cost Wi-Fi, Bluetooth, or Zigbee chipsets, originally intended for short range digital signal transmission. Such chipsets are commercially available from a number of vendors, including Atheros, Broadcom, Intel and other companies.

Typically a number of changes must be made to the IEEE 802.11 standard in order to enable chipsets based upon this design to operate over longer distances. These changes include modifications to the ACK timeouts. This is because the standard 802.11 stop and wait "ACK" recovery settings works poorly when, due to longer distances and speed of light issues, propagation delays are longer. As used in this patent, the criteria for chipsets that are useful for the invention are chipsets that, with proper software or chipset firmware adjustments, are capable of implementing the IEEE 802.11 (Wi-Fi), IEEE 802.15 (Bluetooth), or IEEE 802.15.4 (Zigbee) standards. This definition is suitable, because these are exactly the chipsets that are produced in extremely high volume, and thus capable of meeting the rigorous cost objectives of the invention. However here the term capable is not to imply that the software or firmware that is driving the chipset is fully implementing the exact IEEE 802.11 (Wi-Fi), IEEE 802.15 (Bluetooth), or IEEE 802.15.4 (Zigbee) standards. Rather these standards may be relaxed or modified as necessary to accommodate the much longer (often mile or more) transmission paths typically implemented by the invention.

Figure 1:
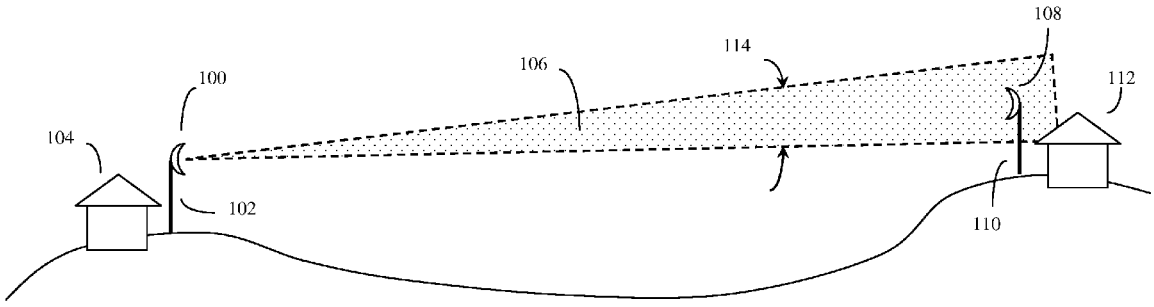
FIG. 1 shows the general problem of aligning one directional antenna on a tower with another directional antenna on a tower.

FIG. 1 gives a drawing that illustrates the problem. Here a human service worker (not shown) handling a first long distance directional Wi-Fi antenna (100) mounted on pole or tower (102) and serving building (104) is attempting to adjust the angle of the antenna both horizontally and vertically so as to have its directional radio beam (106) properly impinge upon a second target long distance directional Wi-Fi antenna (108) mounted on pole or tower (110) and serving building (112) which may be many miles or kilometers away. Clearly as the angle of the radio beam (114) becomes narrower and the distance between the two antennas becomes longer, the difficulties of orienting the two antennas (100) and (108) can become increasingly great.

As one example of a specific long range wireless link, the height of the poles or towers (102), (110) could be 75 feet high, and for both radios, the transmitter power might be 20 dBm, the receiver sensitivity may be −74 dBM, and the frequency of operation might be 2.4 GHz or 5.8 GHz, and the desired wireless data rate might be 54 Mbps. Here the antenna gain for both antennas may be 24 dBi, the beam width of both antennas (100) and (108) might be 8 degrees, and the distance between towers might be 6 km.

As previously discussed, the antennas (100), (108) on the two towers (102), (110) are typically aligned by skilled professionals who often have to climb the tall towers, and manually adjust the antenna to an alignment where the signal quality is highest. Here, signal strength (often measured using an LED bar graph) or intensity of an audio tone emitted by the distant target tower is often used as an alignment criteria.

Figure 2:
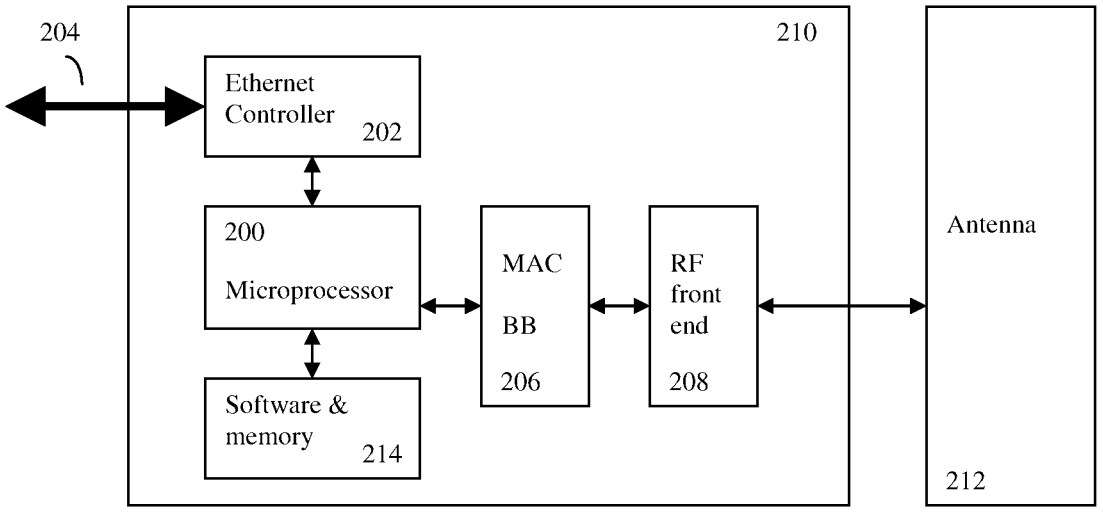
Figure 2 (Prior Art)
FIG. 2 shows the circuit diagram of the electronics used in a typical prior art IEEE 802.11 or compatible Wireless-LAN system.

The prior art circuitry required to operate and align such Wireless LAN systems was also relatively simple. A diagram giving one example of this prior art circuitry is shown in FIG. 2. This process is usually controlled by microprocessor (200). Microprocessor (200) in turn receives both data and commands from Ethernet controller (202) which in turn receives data and commands, and often power as well, over LAN cable (204), which can be a power over LAN cable. The microprocessor (200) in turn sends and receives data and commands with Media Access Controller (MAC) and Base Band unit (BB) (206). These may be implemented either using one or two separate integrated circuits, or alternatively integrated along with the microprocessor (200) into a single integrated circuit chip. Alternatively, MAC and BB (206) may connect to microprocessor (200) using various types of personal computer (PC) interfaces, such as mini-PCI, PCI, or other interface. Software and memory used to run microprocessor (200), and optionally the other components, is shown as (214).

The MAC and BB units in turn send and receive data and commands with the Radio frequency (RF) front end (208). These units are themselves are typically part of the WLAN or WPAN specification, and themselves either use specialized chipsets, or are integrated as part of the overall WLAN and WPAN chipsets. The RF front end can contain one or more Wireless-LAN Radio Frequency integrated circuits (IC or RFIC) that convert and direct the base band RF signals into various filters, power amplifiers, Low Noise Amplifiers (LNAs), Mixers (that can convert from a first frequency to a second frequency), RF switches, and the like. Some of these components, such as the RFIC, may be integrated along with the MAC-BB (206) into a single IC chip as well. Often all of these chips are mounted onto a single host board (210).

The antenna (210) is typically a high gain antenna, which in some cases is contained within the same enclosure as the host board (210).

In order to avoid the tedious manual alignment process required by prior art methods, a suitable low-cost automated system is required. Ideally, this system will combine the Radio Frequency Wireless-LAN chipset needed to drive a directional antenna with suitable low cost motors, gears, driver circuitry, and software needed to produce a low-cost system that can automatically align itself. Because the system will often be used in rural settings by unskilled workers working in a low-budget situation, ideally the combination RF antenna driver/antenna alignment device should also be unitized, simple to operate, and preferably weather resistant as well. To reduce mailing costs, which can be a significant amount of the total cost for a low budget system, the device should also be light weight.

Figure 3:
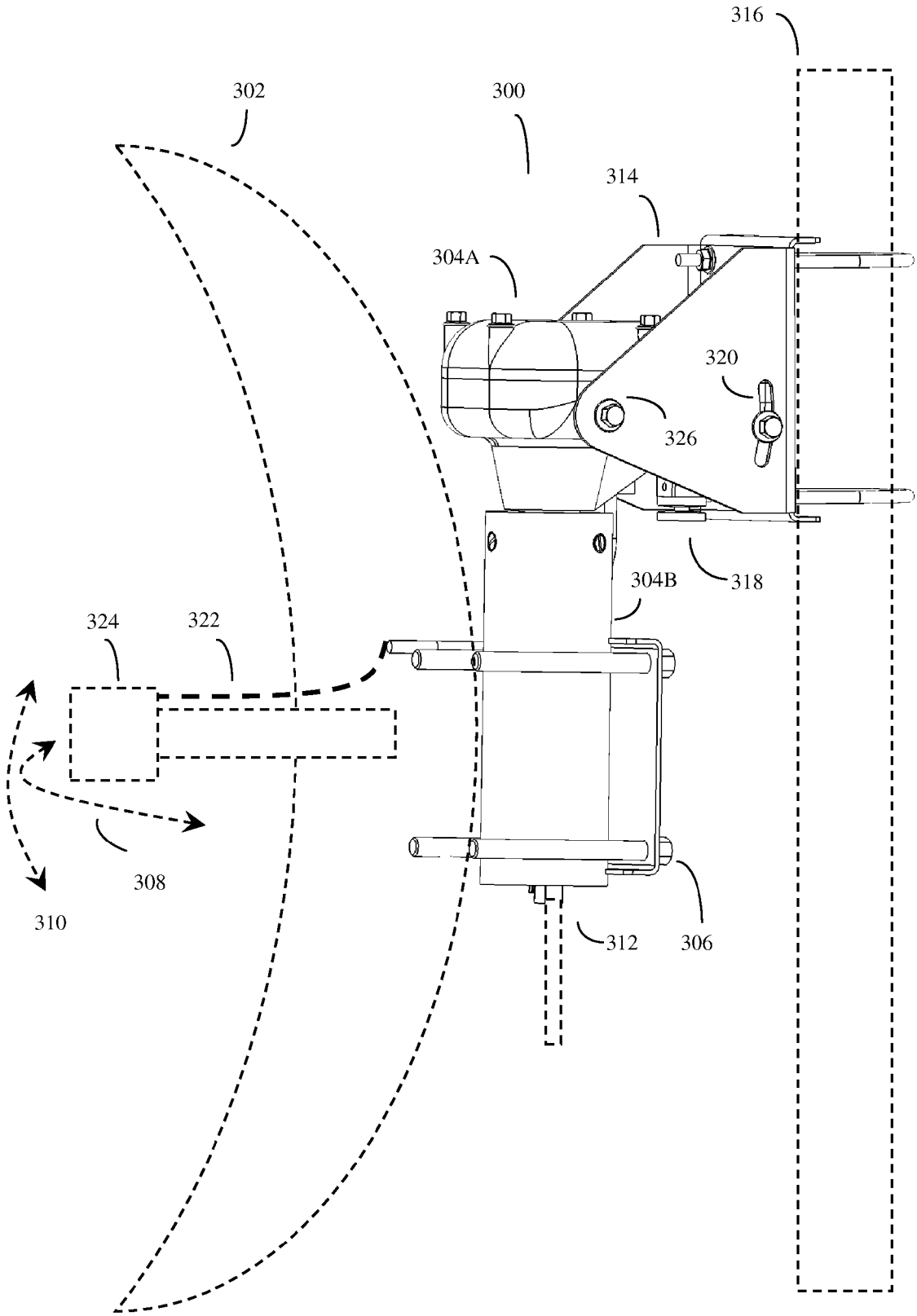
FIG. 3 shows the unitized Wireless-LAN radio and directional antenna aligner device attached to a directional antenna and a support pole.

FIG. 3 shows one embodiment of the invention (300). The invention combines the motors and gears for a directional antenna (302), as well as the electronic circuitry to implement a Wireless-LAN digital radio transceiver, into a single chassis (304) which may have an upper part (304A) and a lower part (304B). The chassis as a whole will be designated as (304). In most embodiments, the antenna and support pole will be considered to be separate from the invention, which is why FIG. 3 shows these components with dashed lines. However as will be discussed, in an alternate embodiment, the directional antenna may be integrated with the invention and device, and the antenna and device sold as a unit.

The invention's case or chassis will usually also be provided with a number of additional items, including an antenna mounting fixture (306) for the directional antenna (302), and a support mounting fixture to attach the device to a support (314). Inside the case or chassis, there will usually be at least a first motor (horizontal motor) configured to rotate the directional antenna (302) in a horizontal axis (308). The chassis may optionally also have a second motor (vertical motor) configured to rotate the directional antenna (302) in a vertical axis (310) as well.

Also inside the chassis (304) are one or more electronics circuit boards or assemblies that will usually contain at least a Wireless-LAN capable chipset, microprocessor, memory, software, motor driver circuitry. This electronic assembly will usually send and receive data and commands from outside devices through a wire data connector (312). This wire data connector can be one or more wires, or a jack for such one or more wires. Often the wire data connector will be mounted inside chassis (304) but will extend outside of chassis (304) as well. This wire data connector may be a high speed serial link such as an Ethernet connector or USB connector, or other type of link. In some embodiments, such as a power over Ethernet wire data connector, USB data connector, or other type of connector, this wire data connector will also transmit power to operate the electronics assembly and optionally the motors.

The software in the electronics assembly may be configured to allow an external computer to directly control the operation of the motors that move the antenna horizontally and optionally vertically. The software in the electronics assembly may also be configured to set the Wireless-LAN capable chipset to operate in the desired frequency range and with the desired parameters required to establish a link with a remote target wireless LAN, and report link success and link data (i.e. intensity of link, quality of link (number of dropped data packets, etc.) to an external computer, and data will often be communicated to this external computer by wire data connector (312).

Alternatively, the software in the electronics assembly may also be configured for easy setup, in which case the software may additionally automate some of the alignment tasks. For example, the software may automatically determine which horizontal antenna angle adjustment and/or vertical antenna angle corresponds to an optimum target signal and direct the horizontal motor and optionally the vertical motor to put the antenna into this optimum position. Some examples of this will be provided later in this disclosure.

As previously discussed, the chassis (304) will often be connected to a support mounting fixture (314). This support mounting fixture will allow the chassis (304) and attached antenna (302) to be attached to a support structure (316), such as a tower or a pole. In some embodiments, this support structure is not considered to be part of the invention and is thus designated as a dashed line. Likewise in some embodiments, the directional antenna (302) is not considered to be a part of the invention either, and is thus also designated as a dashed line. However the directional antenna (302) and support pole (316) may also be sold as a kit with device (304), antenna mounting fixture (306), support mounting fixture (314) as customer demand dictates.

In some embodiments of the invention, where the chassis (304) contains a vertical motor designed to allow (cause) the antenna (302) to swing up and down on a vertical axis (310), then the mounting fixture (314) may be designed or configured to allow the directional antenna (302) to swing up and down. One possible way to accomplish this is by a vertical motor that can advance or retract a screw fixture (318). Note that in this figure, the support mounting fixture (314) has slots (320) and pivot point (326) designed to allow chassis (304) to swing back and forth depending upon the extension or retraction of this screw fixture (318). Note that in order to better show this screw fixture (318), the lower floor of the mounting fixture (314), where the screw fixture (318) would normally push against, is not shown.

Note also that in FIG. 3, an RF cable (322) connects the RF circuits and the Wireless-LAN circuits inside case (304) with the feed (324) or other RF connection portion of antenna (302).

As previously discussed, the Wireless-LAN capable chipset inside case (304) will be selected to be a chipset capable, at least when configured with the proper software settings, of complying with IEEE standards such as the various IEEE 802.11 (Wi-Fi), IEEE 802.15 (Bluetooth) and 802.15.4 (Zigbee) standards. Note also, that as previously discussed, due to timing differences and other factors associated with long distance (mile or more) communications, often the various parameters and other settings may be different, and thus the chipsets when configured with the actual long distance software will often be running outside of the exact IEEE 802.11 (Wi-Fi), IEEE 802.15 (Bluetooth) and 802.15.4 (Zigbee) standards.

Although the IEEE 802.11 (Wi-Fi), IEEE 802.15 (Bluetooth) and 802.15.4 (Zigbee) standards typically call for operation at approximately 2.4 Gigahertz or approximately 5.8 Gigahertz, and although operation at approximately these frequencies can be favored as they often fall within "free use" or unlicensed frequencies where government permits to operate are not required, if operation at other frequencies is desired, optionally one or more mixer electronic circuits may be also incorporated as part of the electronics assembly inside case (304).

Other electronics devices may also be included in the electronics assembly. Examples of additional devices and functions include RF antenna cables, RF connectors, RF front ends, RF power amplifiers, LNAs, and RF switches.

In some cases, the device may be mounted indoors or in a dry climate, in which case or chassis (304) need not be water proof. However in situations where the device will be mounted outdoors and exposed to the environment, in a preferred embodiment, case or chassis (304) is a water resistant or water proof chassis.

In view of the low-cost objectives, often it will be useful to make the gears and/or chassis of the device from strong light-weight materials such as plastic, nylon, fiberglass, glass-filled plastic and glass-filled nylon. In order to reduce shipping and postage costs, as well as to reduce weight, complexity, and expense of the support structure (316), often it will be advantageous to make the weight of the device, at least without the antenna, extremely light, such as under 500 grams or under 1 kilogram.

Figure 4:
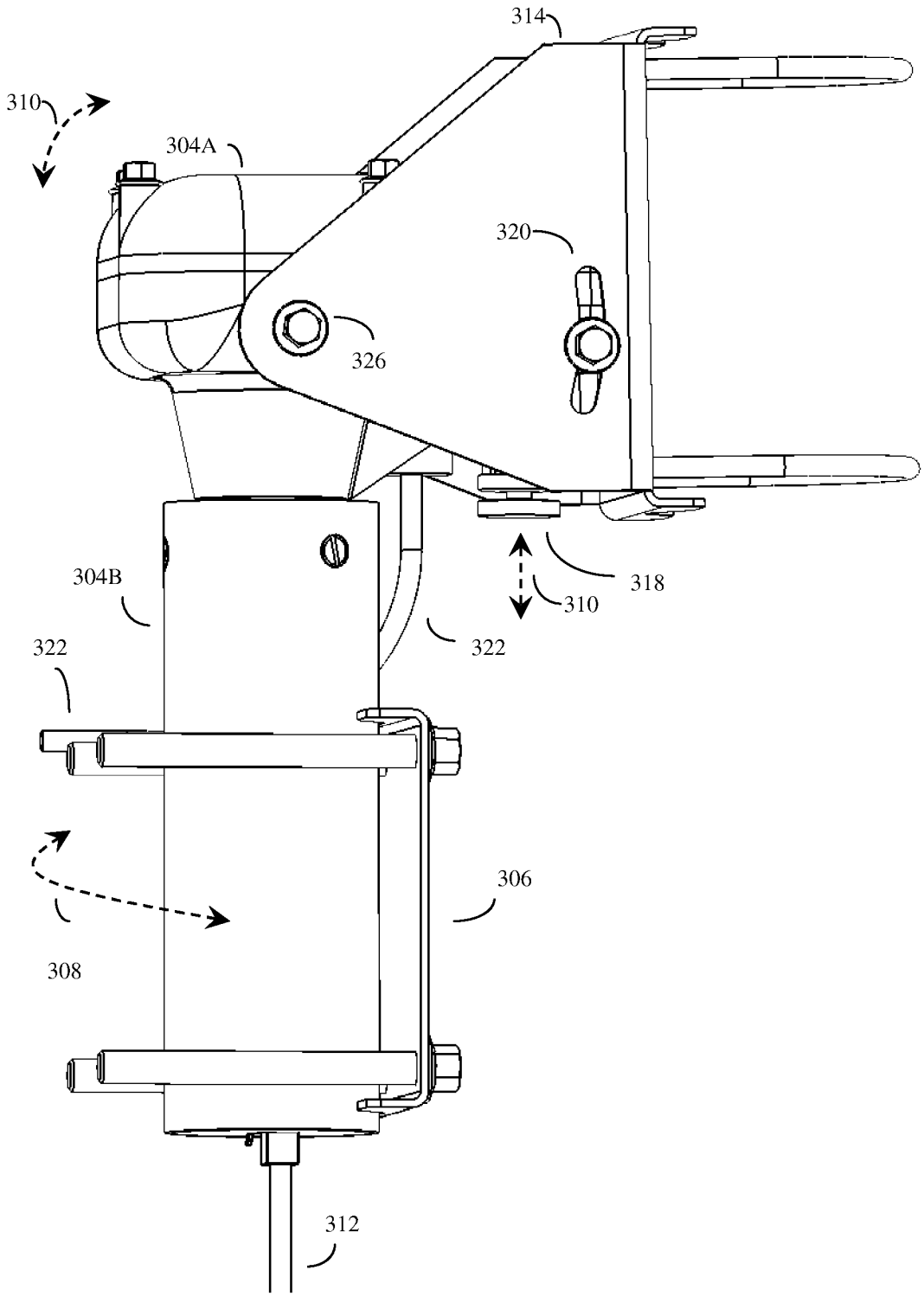
FIG. 4 shows a close up of the unitized Wireless-LAN radio and directional antenna aligner device attached to support and antenna mounting brackets.

FIG. 4 shows a close up of the chassis (304A), (304B) with the antenna (302) and support (316) removed. As can be seen, lower part of the chassis (304B) is capable of partial horizontal rotation (308), and the antenna (302) moves because it is attached to the lower part of chassis (304B) by mounting fixture (306). Additionally, the entire chassis (304A) and (304B) is optionally capable of swinging up and down vertically (310) by pivoting around pivot point (326) and slot (320) using vertical screw fixture (318), which will normally push against the floor of mounting fixture (314) (not shown). This will in turn move antenna (302) up and down vertically.

Figure 5:
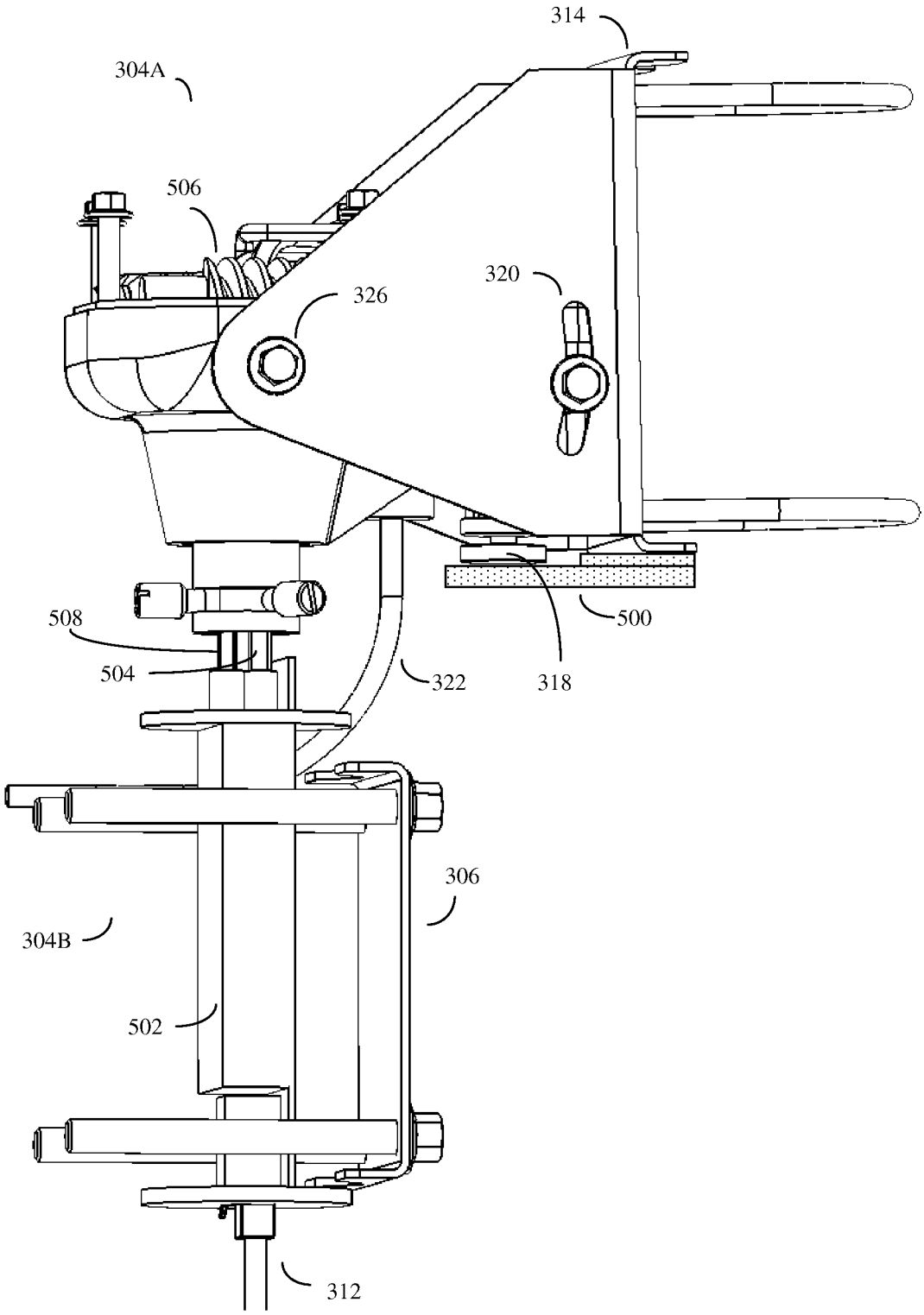
FIG. 5 shows a close-up of the unitized Wireless-LAN radio and directional antenna aligner device attached to support and antenna mounting brackets, but with the top cover and bottom cover removed, exposing details of the internal components.

FIG. 5 shows a close up of the chassis (304A), (304B) previously seen in FIG. 4, but this time with the top cover of chassis (304A) and the bottom cover of chassis (304B) removed, exposing some of the inner components. In this picture, the lower floor of the mounting fixture (314), where the screw fixture (318) would normally push against, is drawn in as part (500). In this example, most of the device's electronics, with the exception of the motors, are located in electronics box (502). The lower (304B) portion of the device is connected to the upper (304A) portion of the device with a rotating shaft (504) normally connected to a horizontal motor and gear arrangement located in the upper (304A) upper portion of the device. A portion of the worm gear arrangement used by the horizontal motor is shown as (506). The electronics in the electronics box (502) communicate with the motors and other cables (such as RF cable (322)) in the 304A portion of the device by way of cable assembly (508), which may contain a plurality of cables (RF cables, motor control cables, motor power cables) as appropriate.

There is no requirement that the majority of the device's electronics (502) be located in the lower portion of the device and in alternate embodiments, the electronics may be located in the 304A portion of the device as well, or split between sections as space constraints and other design constraints dictate.

Figure 6:
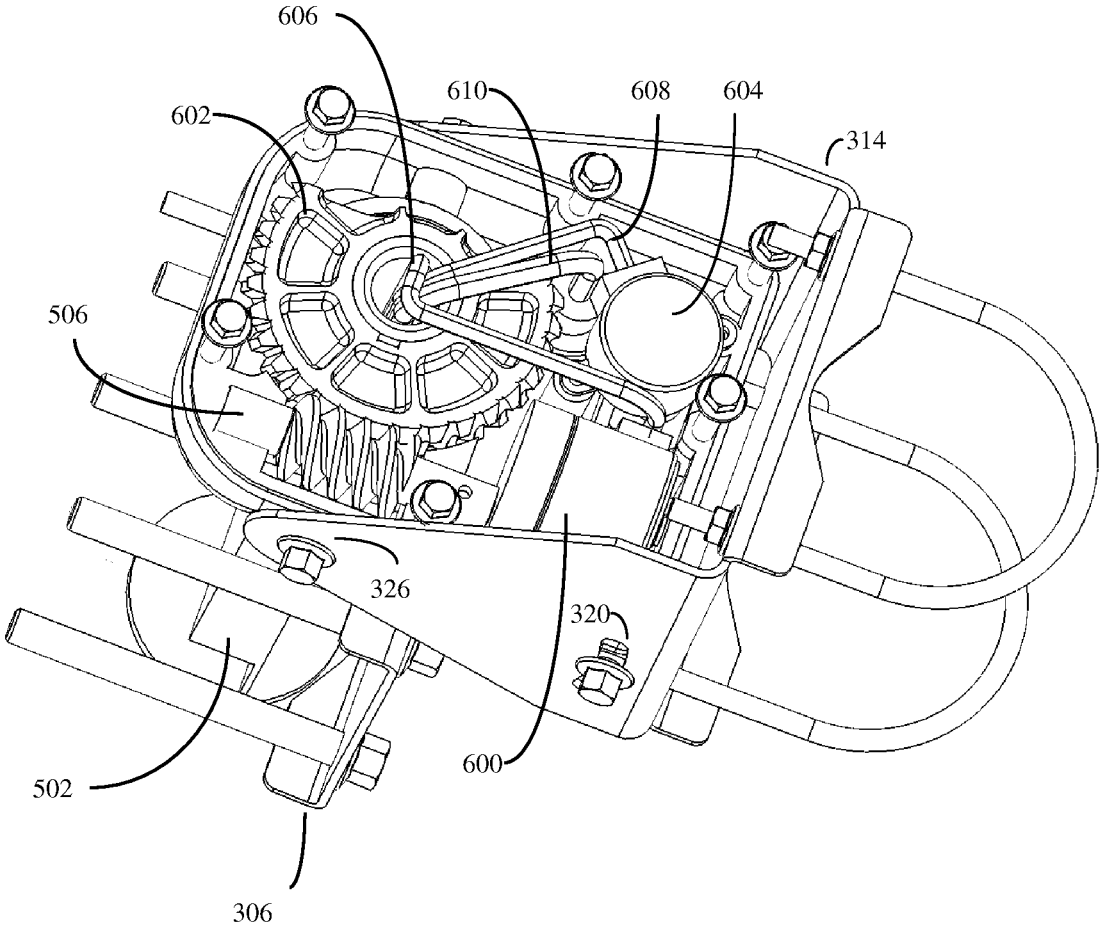
FIG. 6 shows a top down view of the unitized Wireless-LAN radio and directional antenna aligner device attached to support and antenna mounting brackets, showing details of the horizontal motor, gears, and vertical motor used to align the antenna.

FIG. 6 shows the device from FIG. 5, now from a top down perspective. The horizontal motor (600), horizontal motor gear (602), worm gear (506), and optional vertical motor (604) can be seen. The cable assembly (508) from the previous figure has split into several different cables, including one cable to drive the horizontal motor (606), one optional cable to drive the optional vertical motor (608), and a cable (610) to feed the RF signal to and from the RF cable (322) which in turn connects to antenna (302).

Figure 7:
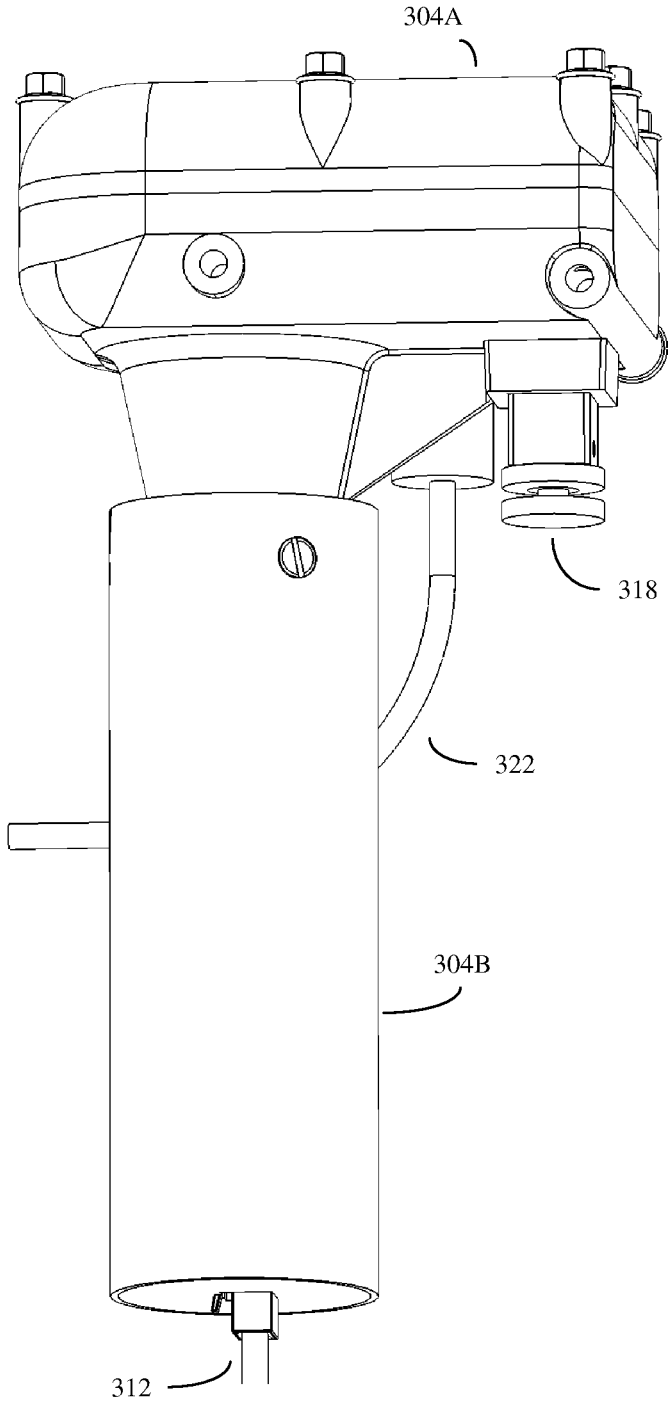
FIG. 7 shows a close up of the unitized Wireless-LAN radio and directional antenna aligner device with the cover on, but now detached from the support and antenna mounting brackets. This angle allow the vertical adjust mechanism to be seen. The case for this portion is often designed to be water resistant or water proof.

FIG. 7 shows the device and the extent of the case or chassis (304A), (304B) (which in many embodiments will be water resistant or water proof) with support mounting fixture (314) and antenna mounting fixture (306) removed. Note that the motors, gears, electronics and other essential components are inside or attached to this case or chassis, and thus this can be considered to be a single unitized device. Depending upon the degree of water proofing or water resistance desired, the wire data connector (312) can either be a plug such as a female or male Ethernet or USB plug, or alternatively the wire data connector can be a seamless insulated wire with no spaces or cracks to admit outside water. In still other embodiments, the wire data connector (312) can be a plug with an additional waterproof closure mechanism.

Figure 8:
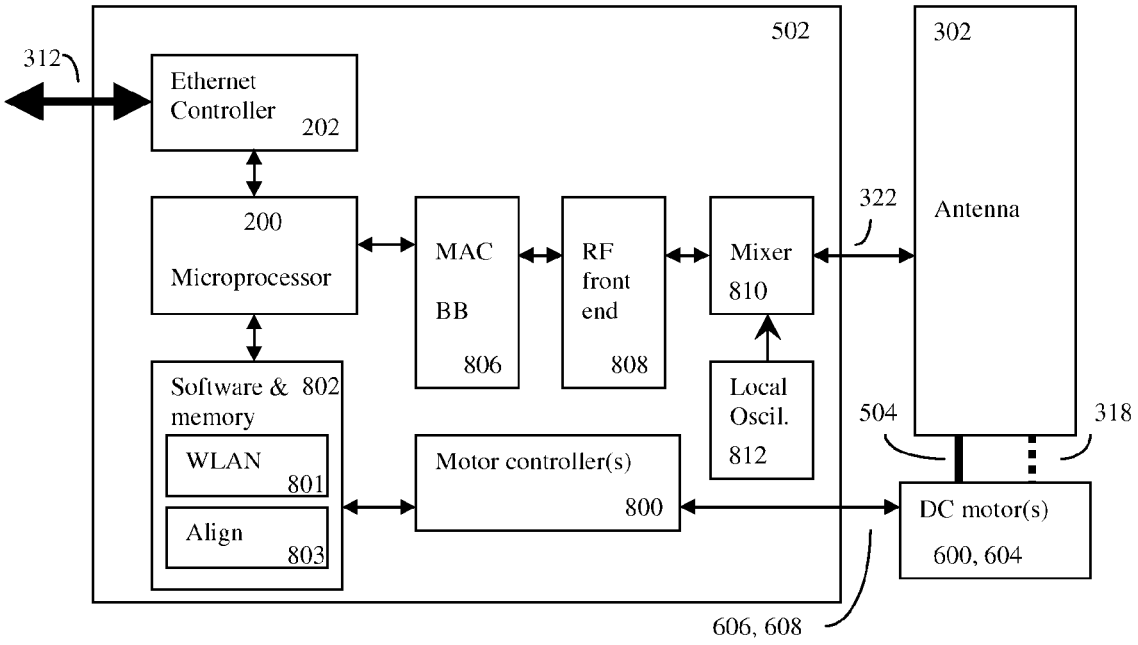
FIG. 8 shows a circuit diagram of the electronics used to run the unitized Wireless-LAN radio and directional antenna aligner device.

FIG. 8 shows an electrical circuit diagram for the device. In this example, the Ethernet controller (202), microprocessor (200), MAC/BB (806), the RF front end (808) and optional RF circuits such as an optional mixer (810) and local oscillator for the mixer (812) may be located on one or more circuit boards, and may be mounted in electronics box (502) or other locations. Here Ethernet controller (202) provides alignment data to a microprocessor (200), the microprocessor (200) functioning to execute alignment software instructions (803) in accordance with a flow diagram (900), as described in greater detail below. A wire data connector (312) may provide target parameter data to the Ethernet controller (202) for performing the alignment of an external high-gain antenna (302). The microprocessor (200) may respond to the target parameter data by sending and receiving wireless alignment signals via an RF front end (808), the RF front end (808) being electrically connected to an optional mixer (810) with a frequency controlled by local oscillator (812). The optional mixer (810) is then usually electrically connected to the external high-gain antenna (302) via an RF cable (322) as shown, or (in other embodiments) directly without use of RF cable (322). In the absence of the optional mixer (810), the RF front end (808) is electrically connected to the external high-gain antenna (302) via an RF cable (322) as shown, or (in other embodiments) directly without use of RF cable (322). Signal strength readings obtained for the wireless alignment response signals transmitted from a remote antenna (not shown) and received at the high-gain antenna (302) may be retained in a memory (802) for use in the alignment process described in the flow diagram (900).

The wireless alignment signals sent by the RF front end (808) may pass through a media access controller (806) electrically connected to the microprocessor (200), as is well known in the relevant art. The RF front end (808) may comprise a wireless LAN capable chipset, operating at one or more industrial, scientific, and medical (ISM) frequencies, for example, such as may lie within a frequency band centered at 915 MHz, 2.450 GHz, or 5.800 GHz. In an exemplary embodiment, the wireless LAN capable chipset may operate in general conformance with the IEEE 802.11 standard, the IEEE 802.15 standard, or the IEEE 802.15.4 standard. As discussed above, the software instructions which may be stored in memory (WLAN controller memory (801), or other memory (802)) may include modifications to the standard 'ACK' timeouts. These modifications serve to mitigate errors that may be incurred from the standard 'ACK' recovery mechanism due to the propagation delays between the external high-gain antenna (302) and the remote antenna.

In accordance with the flow diagram (900), the alignment software instructions (803) may be executed by the microprocessor (200) to thereby provide suitable antenna alignment signals to an antenna alignment motor controller (800). The antenna alignment motor controller (800) accordingly functions to operate DC motor(s) (600), (604), such as a step motor, mechanically coupled to the high-gain antenna 302 via a rotatable shaft (504) or screw (318) or other mechanical coupling. The DC motor (600) may selectively rotate the high-gain antenna (302) clockwise or counterclockwise so as to orient the high-gain antenna (302) along the azimuth so as to obtain a maximum signal strength reading from the remote antenna wireless response signals. In an alternative exemplary embodiment, the antenna alignment controller (800) may also operate a second DC motor (604) mechanically coupled to selectively rotate the high-gain antenna (302) along an elevation axis (i.e., in a vertical plane). Note that for clarity, the DC motor(s) (600), (604) are drawn as being mounted outside of the electronics box or enclosure (502) but in fact may be mounted anywhere, although typically inside of the overall device case (304).

Examples of suitable Wi-Fi (IEEE 802.11) chipsets for (806) and (808) include Wi-Fi Chipsets produced by Atheros, Broadcom, Intel, and Ralink, such as the Atheros AR5414, AR7240, AR9285, and AR9170 chipsets. Examples of suitable Bluetooth (IEEE 802.15) include chipsets made by Broadcom, Renesas, and CSR, such as the Broadcom BCM2045, BCM2004, and BCM2048 chipsets. Examples of suitable Zigbee (IEEE 802.15.4) chipsets include chipsets made by Texas Instruments, Freescale, Renases, and Atmel, such as the Atmel AT86ZL3201, AT86RF210 chipsets. Examples of the use of mixers or integrated frequency converters (810) to change frequency include the Ubiquiti Networks XtremeRange3 (converts 5 GHz to 3.3 GHz), Ubiquiti Networks XtremeRange9 (converts 2.4 GHz to 900 MHz), and the Dbii Networks F33 (converts 5 GHz to 3.3 GHz) devices.

Figure 9:
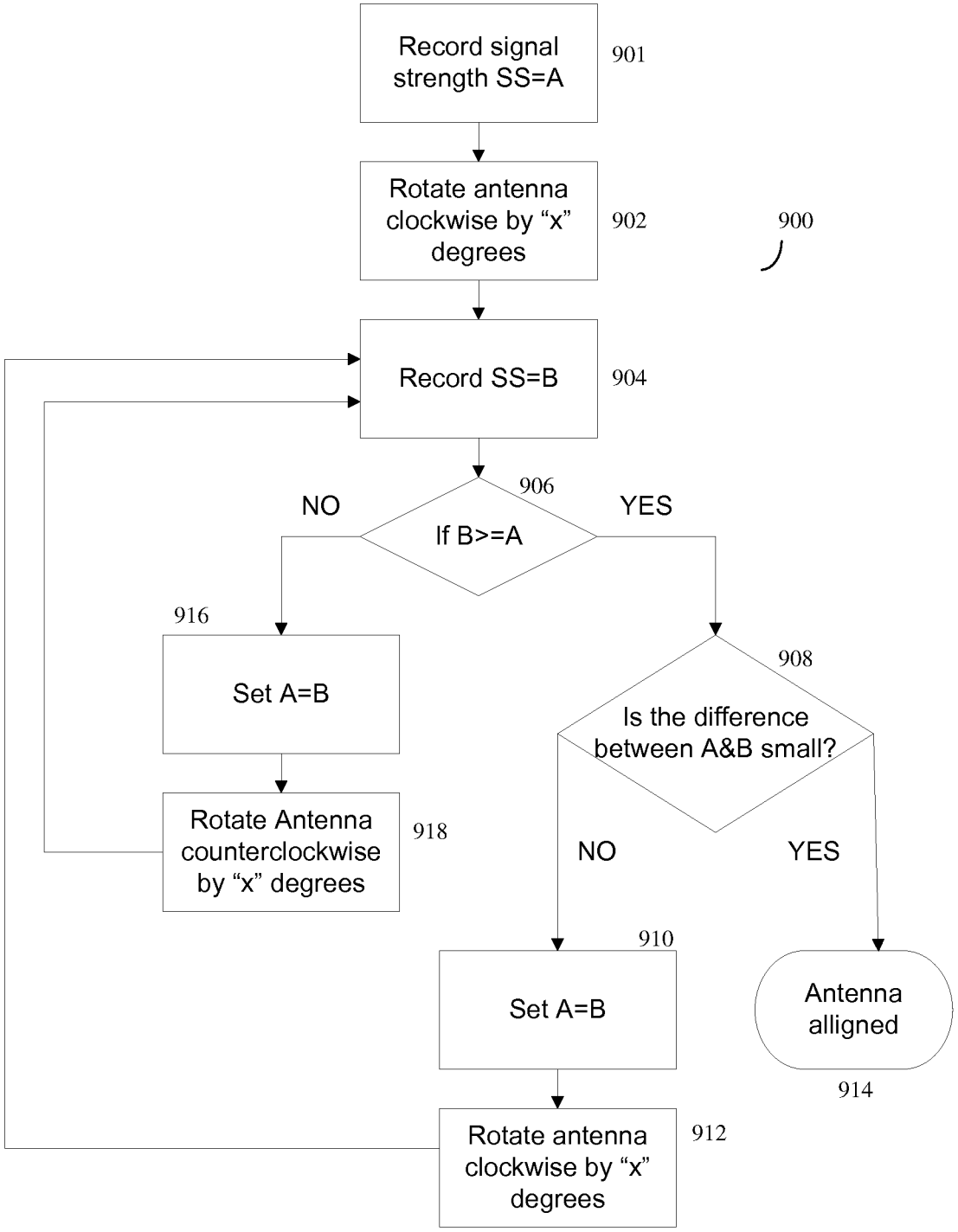
FIG. 9 shows a software flow chart showing one example of the software that may be used to automatically align the antenna to an optimum setting.

FIG. 9 shows a simplified example (900) of the overall onboard software (802) that may be used to implement the invention. In this example, microprocessor (200) has already received commands from Ethernet cable (312) or elsewhere telling the microprocessor and WLAN setting software (801) to configure the Wireless LAN chips (806) and (808) to receive signals from a target Wireless-LAN, and the basic antenna optimization angle routine has commenced. In this simplified example, only one degree of antenna movement (here assumed to be horizontal movement) is specified.

Here the optimum antenna angle search begins by setting the antenna to a known location, such as an extreme counterclockwise position, or last known good location, and recording the signal strength or signal quality of the target Wireless-LAN at that position (901) and assign this result to variable "A". The alignment software (803) will then instruct the antenna to, for example, rotate clockwise by a few degrees (902), and again record the signal strength or quality of the target Wireless-LAN (904), and assign this result to variable "B". The software will then compare the two signals (906) and if the new signal is significantly better than the old signal (908), assume that the antenna is moving closer to an optimum alignment. The system will then reset the value of the "A" signal to the "B" signal (910), advance the antenna clockwise still further by a few degrees (912), and try again (902). If the new signal is not significantly better, the system will assume that the antenna is positioned approximately correctly (914) and the adjustment operation will terminate.

On the other hand, if the antenna has moved past the optimum, then the new signal "B" may be quite a bit less than the original signal "A". In this case, the antenna needs to back up. To do this, the "A" signal is again made equal to the "B" signal (916) but this time the antenna is told to reverse direction (go counterclockwise) by a few degrees (918), and the process then recommences at (904).

Much more sophisticated antenna alignment schemes, often involving a search in both horizontal alignment and vertical alignment, can also be done. These searches can also make use of prior stored best antenna position information to speed up the search, and can also perform various types of noise rejection and statistical data averaging in order to improve the speed and accuracy of the results.

To facilitate an easy user interface, software (802) may present a user interface as a graphical interface in a web browser that can be easily accessed by a user computer over Ethernet or other cable (312). Software (802) may also run directly on "bare metal", or alternatively run under an operating system such as Linux.

This software can optionally be configured to be simply implemented by pushing an "auto align" on the device, or remotely through the Wireless-LAN link (useful when an unattended unit must be remotely serviced), or through direct commands from a user's computer over an Ethernet or other link (312), as previously described.

OTHER EMBODIMENTS

In another embodiment, the invention is a method of adjusting the orientation of a directional antenna. This method works by mounting a unitized combination actuator and digital radio transceiver device for a directional antenna on a support structure. Here, as previously described, the device is a chassis containing a mounting fixture for a directional antenna. At least one motor (horizontal motor) configured to rotate the directional antenna in a horizontal axis, is mounted inside the chassis, and an electronics assembly with at least a Wireless-LAN capable chipset, microprocessor, memory, software, motor driver circuitry, and a high-speed serial interface will also be mounted inside the chassis.

Here a directional antenna is attached to the devices' antenna mounting fixture. The user will often start the scanning process by sending or transmitting to the device, data pertaining to the signal parameters of at least one external directional long-distance Wireless LAN compatible target source. Then either the user, or the device itself, can then transmit commands to the devices' horizontal motor (and optionally the vertical motor as well (if any) to move the directional antenna across a range of horizontal angles (horizontal angle adjustment) and optionally vertical angles (vertical angle adjustment).

As previously discussed in FIG. 9, the scanning process will then work by directing the unit to attempt to receive a Wireless-LAN signal from the target source (or if more than one source is to be a target, from multiple target sources), and to monitor if the target source is present, and if so what the intensity or quality (i.e. packet loss characteristics) of the target source signal are. Then, using a search method similar to that discussed in FIG. 9, the method will then use the horizontal motor and optionally the vertical motor to drive the directional antenna to some optimum value for that signal or set of signals, which may be a preset optimum value.

Note that when the antenna is being directed to find a "best fit" compromise position between a number of different target sources, considerations as to what is "optimum" can tend to be a bit complex. In the case where a best fit between multiple targets is desired, then each target may be assigned a relative priority score based upon pre-negotiated service levels, emergency priority, traffic volume, or other considerations. Then the system may attempt to weight the optimum angle required for each individual signal, and attempt to find a "best fit" method that attempts to find a reasonable compromise that still tends to favor an antenna orientation towards higher priority targets.

Here many best fit priority selection methods are possible, ranging from simple weighted root mean square methods to more complex methods. Alternatively a pre-computed look-up table or function may be used, and such pre-computed tables or functions may be useful in cases, for example, when lower priority targets such as individual homes with lower negotiated services levels have to be cut-off in order to accommodate high priority emergency services such as hospitals, rescue, or more critical industrial targets. In this case uses of such pre-computed tables or functions will help ensure that correct priority decisions are made.

In still other embodiments, antenna (302) may be made an essential component of the device, rather than an optional bolt-on component mounted by antenna mounted fixture (306). In such cases, the extra space available inside the antenna structure itself, such as inside the feed (322), may be used to house some of the Wireless-LAN chips or other support circuitry for the invention.

Although certain specific examples of suitable Wireless LAN chips and chipsets, such as those chipsets originally designed for point-to-point distances under 300 to 1000 feet, exemplified by the IEEE 802.11 (Wi-Fi), IEEE 802.15 (Bluetooth), or IEEE 802.15.4 (Zigbee) standards, these specific citations are not intended to exclude use of future short-range digital wireless technology that is also designed for point-to-point distances up to at most 300-1000 feet, or even shorter distances, such as 30 to 300 feet. In general, any IEEE standard or any chipset intended for short-range Wireless-LAN communications between about 30 and 1000 feet is within the scope of this invention.

The invention claimed is:

1. A unitized combination actuator and digital radio transceiver device for a directional antenna, comprising:

a chassis containing a mounting fixture for a directional antenna;

at least a first motor (horizontal motor) configured to rotate said directional antenna in a horizontal axis, mounted inside said chassis;

an electronics assembly comprising at least a Wireless LAN capable chipset, microprocessor, memory, software, motor driver circuitry, and a wire data connector mounted inside said chassis;

said software being capable of directing said microprocessor to read said wire data connector for input data (target parameter data) pertaining to the signal parameters of at least one Wireless LAN compatible target source;

said software being capable of directing said microprocessor to drive said first horizontal motor, thus moving said directional antenna across a range of horizontal angles (horizontal angle adjustment);

said software being capable of setting said microprocessor and/or said Wireless LAN capable chipset to target parameter data settings capable of receiving a signal from said target source (target signal), and then to monitor for the presence and quality of said target signal;

said software being capable of transmitting data pertaining to said horizontal angle adjustment and said target signal on said wire data connector and/or determining which horizontal angle adjustment corresponds to an optimum target signal (optimum position), and directing said first horizontal motor and said antenna into said optimum position.

2. The device of claim 1, in which said Wireless LAN capable chipset is capable, when configured with the proper software settings, of complying with IEEE standards selected from the group consisting of IEEE 802.11 (Wi-Fi), IEEE 802.15 (Bluetooth) and 802.15.4 (Zigbee) standards.

3. The device of claim 1, in which said electronics assembly additionally comprises a mixer capable of altering the frequency of the Wireless LAN capable chipset.

4. The device of claim 1, in which said wire data connector is a high speed serial interface elected from the group consisting of Universal Serial Bus interfaces, Ethernet interfaces, or power over Ethernet interfaces.

5. The device of claim 1, in which said chassis is a waterproof chassis.

6. The device of claim 1, in which said electronics assembly additionally comprises additional electronics components selected from the group consisting of RF antenna cables, RF connectors, RF front ends, RF power amplifiers, LNAs, and RF switches.

7. The device of claim 1, further comprising at least a second motor (vertical motor) connected to a mounting fixture configured to swing up or down on a vertical axis, thus allowing said directional antenna to swing up or down;

said software being further capable to direct said microprocessor to drive said vertical motor to move said directional antenna across a range of vertical angles (vertical angle adjustment);

said software being additionally capable of transmitting data pertaining to said vertical angle adjustment, said horizontal angle adjustment, and said target signal on said wire data connector and/or determining which vertical angle adjustment and which horizontal angle adjustment corresponds to said optimum target signal (optimum position) and directing said horizontal motor and said vertical motor and said antenna into said optimum position.

8. The device of claim 7, further containing a worm gear, gear assembly, and screw fixture;

in which said horizontal motor is configured to rotate said chassis by turning a said worm gear and said gear assembly across a first horizontal axis;

said second vertical motor is configured to advance or retract said screw fixture screw, said screw fixture being connected to a mounting fixture configured to swing up or down on a vertical axis corresponding to the extent of advancement or retraction of said screw fixture, thus allowing said directional antenna to swing up or down corresponding to the advancement or retraction of said screw fixture.

9. A unitized combination actuator and digital radio transceiver device for a directional antenna, comprising:

a chassis capable of being mounted onto the end of an antenna pole, and containing a mounting fixture for a directional antenna;

at least one motor (horizontal motor) configured to turn a worm gear and gear assembly (gears) across a first horizontal axis thereby rotating said directional antenna in a horizontal axis, mounted inside said chassis;

an electronics assembly comprising at least a Wireless-LAN capable chipset, microprocessor, memory, software, motor driver circuitry, and a high-speed serial interface mounted inside said chassis;

said software being capable of directing said microprocessor to read said high speed serial interface for input data (target parameter data) pertaining to the signal parameters of at least one Wireless LAN compatible target source;

said software being capable of directing said microprocessor to drive said horizontal motor, thus moving said directional antenna across a range of horizontal angles (horizontal angle adjustment);

said software being capable of setting said microprocessor and/or said Wireless LAN capable chipset to target parameter data settings capable of receiving a signal from said target source (target signal), and then to monitor for the presence and quality of said target signal;

said software being capable of transmitting data pertaining to said horizontal angle adjustment and said target signal on said high-speed serial interface and/or determining which horizontal angle adjustment corresponds to an optimum target signal (optimum position), and directing said horizontal motor and said directional antenna into said optimum position.

10. The device of claim 9, in which said high speed serial interface is selected from the group consisting of Universal Serial Bus interfaces, Ethernet interfaces, or power over Ethernet interfaces.

11. The device of claim 9, further comprising at least a second motor (vertical motor) configured to advance or retract a screw, said screw being connected to a mounting fixture configured to swing up or down on a vertical axis corresponding to the extent of advancement or retraction of said screw, thus allowing said antenna to swing up or down corresponding to the advancement or retraction of said screw;

said software being further capable to direct said microprocessor to drive said vertical motor to move said directional antenna across a range of vertical angles (vertical angle adjustment);

said software being additionally capable of transmitting data pertaining to said vertical angle adjustment, said horizontal angle adjustment, and said target signal on said high speed serial interface and/or determining which vertical angle adjustment and which horizontal angle adjustment corresponds to said optimum target signal (optimum position) and directing said horizontal motor and said vertical motor and said directional antenna into said optimum position.

12. The device of claim 9, in which said Wireless-LAN capable chipset is capable, when configured with the proper software settings, of complying with IEEE standards selected from the group consisting of IEEE 802.11 (Wi-Fi), IEEE 802.15 (Bluetooth) and 802.15.4 (Zigbee) standards.

13. The device of claim 9, in which said electronics assembly additionally comprises a mixer capable of altering the frequency of the Wireless LAN capable chipset.

14. The device of claim 9, in which said wire data connector is a high speed serial interface elected from the group consisting of Universal Serial Bus interfaces, Ethernet interfaces, or power over Ethernet interfaces.

15. The device of claim 9, in which at least some of said gears and/or said chassis are made from materials selected from the group consisting of plastic, nylon, fiberglass, glass-filled plastic and glass-filled nylon, and in which the total weight of said device is under 500 grams.

16. A method of adjusting the orientation of a directional antenna, comprising:

mounting a unitized combination actuator and digital radio transceiver device for a directional antenna on a support structure, said device comprising:

a chassis containing a mounting fixture for a directional antenna;

at least one motor (horizontal motor) configured to rotate said directional antenna in a horizontal axis, mounted inside said chassis;

an electronics assembly comprising a Wireless LAN capable chipset, microprocessor, memory, software, motor driver circuitry, and a high-speed serial interface mounted inside said chassis;

attaching a directional antenna to the mounting fixture of said device;

transmitting target parameter data pertaining to the signal parameters of at least one external directional long-distance Wireless LAN compatible target source to said device;

transmitting commands to said microprocessor to drive said horizontal motor, thus moving said directional antenna across a range of horizontal angles (horizontal angle adjustment);

attempting to receive a signal from said at least one target source (at least one target signal) and monitoring for the presence and quality of said at least one target signal;

and using said horizontal motor to move said directional antenna to the horizontal angle associated with a preset level of said at least one target signal.

17. The method of claim 16, in which said Wireless LAN capable chipset is capable, when configured with the proper software settings, of complying with IEEE standards selected from the group consisting of IEEE 802.11 (Wi-Fi), IEEE 802.15 (Bluetooth) and 802.15.4 (Zigbee) standards.

18. The method of claim 16, in which the electronics assembly additionally comprises a mixer capable of altering the frequency of the Wireless LAN capable chipset, and altering the frequency of the Wireless LAN capable chipset.

19. The method of claim 16, in which said device further comprises at least one second motor (vertical motor) configured to rotate said directional antenna across a vertical axis, further comprising:

transmitting commands to said microprocessor to drive said vertical motor, thus moving said directional antenna across a range of vertical angles (vertical angle adjustment);

and using said vertical motor to move said directional antenna to the vertical angle associated with the preset level of said at least one target signal.

20. The method of claim 16, in which said at least one external directional long-distance Wireless LAN compatible target source is one external directional long-distance Wireless LAN compatible target source, and the preset level of said target signal is the highest quality level of said at least one target signal.

21. The method of claim 16, in which said at least one external directional long-distance Wireless LAN compatible target source is a plurality of external directional long-distance Wireless LAN compatible target sources, and said preset level of said at least one target signal is determined based upon a priority selection method.

22. The method of claim 21, in which said priority selection method weighs the relative priority of each target source of said plurality of external directional long-distance Wireless LAN compatible target sources, and selects a preset level of said at least one target signals that assigns a higher preset level to higher priority target sources, thus causing the horizontal angle of said directional antenna to orient more towards higher priority target sources.

23. The method of claim 22, in which said at least one external directional long-distance Wireless LAN compatible target source is a plurality of external directional long-distance Wireless LAN compatible target sources, and said preset level of said at least one target signal is determined based upon a priority selection method;

and in which said priority selection method weighs the relative priority of each target source of said plurality of external long-distance Wireless LAN compatible target sources, and selects a preset level of said at least one target signals that assigns a higher preset level to higher priority target sources, thus causing the vertical angle of said directional antenna to orient more towards higher priority target sources.

24. A unitized combination actuator, digital radio transceiver device, and directional antenna, comprising:

a chassis attached to a directional antenna with an internal structure;

at least a first motor (horizontal motor) configured to rotate said directional antenna in a horizontal axis, mounted inside said chassis;

an electronics assembly comprising at least a Wireless LAN capable chipset, microprocessor, memory, software, motor driver circuitry, and a wire data connector mounted inside said chassis or inside said internal structure of said antenna;

said software being capable of directing said microprocessor to read said wire data connector for input data (target parameter data) pertaining to the signal parameters of at least one Wireless LAN compatible target source;

said software being capable of directing said microprocessor to drive said first horizontal motor, thus moving said directional antenna across a range of horizontal angles (horizontal angle adjustment);

said software being capable of setting said microprocessor and/or said Wi-Fi-capable chipset to target parameter data settings capable of receiving a signal from said target source (target signal), and then to monitor for the presence and quality of said target signal;

said software being capable of transmitting data pertaining to said horizontal angle adjustment and said target signal on said wire data connector and/or determining which horizontal angle adjustment corresponds to an optimum target signal (optimum position), and directing said first horizontal motor and said antenna into said optimum position.

25. The device of claim 24, in which said Wireless LAN capable chipset is capable, when configured with the proper software settings, of complying with IEEE standards selected from the group consisting of IEEE 802.11 (Wi-Fi), IEEE 802.15 (Bluetooth) and 802.15.4 (Zigbee) standards.

26. The device of claim 24, in which the electronics assembly additionally comprises a mixer capable of altering the frequency of the Wireless LAN capable chipset.

27. The device of claim 24, further comprising at least a second motor (vertical motor) connected to a mounting fixture configured to swing up or down on a vertical axis, thus allowing said directional antenna to swing up or down;

said software being further capable to direct said microprocessor to drive said vertical motor to move said directional antenna across a range of vertical angles (vertical angle adjustment);

said software being additionally capable of transmitting data pertaining to said vertical angle adjustment, said horizontal angle adjustment, and said target signal on said wire data connector and/or determining which vertical angle adjustment and which horizontal angle adjustment corresponds to said optimum target signal (optimum position) and directing said horizontal motor and said vertical motor and said antenna into said optimum position.

28. The device of claim 24, in which said Wireless LAN capable chipset is mounted in said internal structure of said directional antenna in the feed position of said antenna.

29. The device of claim 24, in which said wire data connector is a high speed serial interface elected from the group consisting of Universal Serial Bus interfaces, Ethernet interfaces, or power over Ethernet interfaces.

30. An antenna alignment module suitable for use with a motorized antenna, said module comprising:

an antenna alignment motor controller for electrically interfacing with the motorized antenna;

a memory including software instructions for performing antenna alignment;

an RF front end electrically coupled to the motorized antenna, said RF front end for receiving signals from and transmitting signals to the motorized antenna;

a microprocessor electrically coupled to said RF front end via a media access controller, said microprocessor functioning to execute said software instructions to selectively rotate the motorized antenna via said antenna alignment motor control and to monitor a target signal acquired by the motorized antenna from a remote antenna;

an Ethernet controller for sending target parameter data to said microprocessor, whereby said microprocessor responds to said target parameter data so as to place the motorized antenna into a position for receiving a signal having a maximum signal strength from said remote antenna.

* * * * *